US011054235B2

(12) United States Patent
Lee et al.

(10) Patent No.: US 11,054,235 B2
(45) Date of Patent: Jul. 6, 2021

(54) TRUNKLINE DELAY DETONATOR AND BLAST-TRIGGERING DEVICE USING SAME

(71) Applicant: HANWHA CORPORATION, Seoul (KR)

(72) Inventors: Eung So Lee, Boeun-gun (KR); Ki Chul Park, Boeun-gun (KR); Se Hun Kim, Boeun-gun (KR); In Kim, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 16/627,026

(22) PCT Filed: Jun. 28, 2017

(86) PCT No.: PCT/KR2017/006847
§ 371 (c)(1),
(2) Date: Dec. 27, 2019

(87) PCT Pub. No.: WO2019/004496
PCT Pub. Date: Jan. 3, 2019

(65) Prior Publication Data

US 2020/0124391 A1 Apr. 23, 2020

(51) Int. Cl.
*F42D 1/04* (2006.01)
*C06C 5/06* (2006.01)
(Continued)

(52) U.S. Cl.
CPC ..... *F42D 1/043* (2013.01); *C06C 5/06* (2013.01); *C06C 7/00* (2013.01); *C06B 25/04* (2013.01); *C06B 37/00* (2013.01); *C06B 41/02* (2013.01)

(58) Field of Classification Search
CPC ... F42D 1/043; C06C 7/00; C06C 5/06; F42B 3/10; F42B 3/16
See application file for complete search history.

(56) References Cited

U.S. PATENT DOCUMENTS 5,522,318 A * 6/1996 Gladden ..... C06C 7/00 102/202.13
5,703,319 A * 12/1997 Fritz ..... F42D 1/043 102/275.7
(Continued)

FOREIGN PATENT DOCUMENTS

JP 4-236100 A 8/1992
JP 11-513786 A 11/1999
(Continued)

OTHER PUBLICATIONS

International Search Report dated Dec. 28, 2017, issued in counterpart application No. PCT/KR2017/006847 (2 pages).

*Primary Examiner* — Joshua T Semick
(74) *Attorney, Agent, or Firm* — Westerman, Hattori, Daniels & Adrian, LLP

(57) ABSTRACT

The present disclosure relates to a trunkline delay detonator and a blast-triggering device using the same. In the blast-triggering device, a trunkline delay detonator is inserted into a connector in such a manner that a plurality of shock tubes connected to a detonator for initiating an explosive are interposed between the connector and the trunkline delay detonator, so that an explosion signal is applied to the shock tubes by detonation of the trunkline delay detonator. In the blasting detonator, close contact between the outer surface of the trunkline delay detonator and the shock tubes is improved, whereby energy lost in an explosion is reduced and an explosion signal is stably and uniformly applied to the shock tubes by using powder which has a weak explosive power and is relatively insensitive compared to conventional powders.

11 Claims, 8 Drawing Sheets

(51) Int. Cl.

| | |
|---|---|
| ***C06C 7/00*** | (2006.01) |
| ***C06B 25/04*** | (2006.01) |
| ***C06B 41/02*** | (2006.01) |
| *C06B 37/00* | (2006.01) |

(56) References Cited

U.S. PATENT DOCUMENTS 6,006,671 A * 12/1999 Yunan ..... C06C 5/04
102/275.1
6,513,437 B2 * 2/2003 Chan ..... F42D 1/043
102/275.7

FOREIGN PATENT DOCUMENTS

| | | | | | |
|---|---|---|---|---|---|
| JP | 2003-532050 | A | | 10/2003 | |
| KR | 20-1997-0010665 | U | | 3/1997 | |
| KR | 20-2010-0010019 | U | | 10/2010 | |
| KR | 20100010019 | | * | 10/2010 | ..... C06C 5/06 |

* cited by examiner

TRUNKLINE DELAY DETONATOR AND BLAST-TRIGGERING DEVICE USING SAME

TECHNICAL FIELD

The present disclosure relates to a trunkline delay detonator and a blast-triggering device using the same. More particularly, the present disclosure relates to a trunkline delay detonator, which is configured such that, when the trunkline delay detonator detonates, an explosion signal is transmitted only to a shock tube disposed at an end of the detonator by using low-magnitude shock waves without influencing other shock tubes, and a blast-triggering device using the same.

BACKGROUND ART

Generally, a nonelectric blasting device uses a blast-triggering device in order to simultaneously transmit an explosion signal to a plurality of detonators for igniting an explosive.

That is, the blast-triggering device is configured to simultaneously apply the explosion signal to a plurality of shock tubes connected to the plurality of detonators for igniting an explosive in order to simultaneously detonate the plurality of detonators for igniting the explosive.

The nonelectric blast-triggering device includes: a connector, in which a plurality of shock tubes is fitted; and a trunkline delay detonator, which applies an explosion signal to the shock tubes inserted into the connector.

The plurality of shock tubes is configured such that an explosive is inserted therein, and a plurality of detonators for igniting an explosive is connected thereto, so that the explosion signal is transmitted to the plurality of detonators for igniting the explosive through the explosive.

That is, the nonelectric blast-triggering device is operated as follows. The shock tubes connected to the detonators for igniting the explosive are fitted into the connector, and then, as the trunkline delay detonator inserted into the connector detonates, the explosion signal is simultaneously transmitted to the shock tubes through the explosive, and the detonators for igniting the explosive connected to the shock tubes detonate simultaneously therewith.

FIG. 1 is a schematic view showing a connector for a conventional blast-triggering device. Referring to FIG. 1, the connector 5 for the conventional blast-triggering device has a straight rod shape, and has a tube insertion portion 5*a* in which a plurality of shock tubes 1 is fitted at an upper portion of the connector 5, and has a detonator-coupling portion 5*b* in which a trunkline delay detonator 2 is inserted in the longitudinal direction of the detonator-coupling portion 5*b*, the detonator-coupling portion 5*b* being formed to penetrate up to the tube insertion portion 5*a*.

The connector 5 of a conventional blast-triggering device has a flat upper surface. Also, an upper end of the trunkline delay detonator 2 is formed in a flat surface parallel to the upper surface of the connector 5 for the blast-triggering device.

The upper end of the trunkline delay detonator 2 protrudes partway into the tube insertion portion 5*a*. The shock tubes 1 are fitted between an inner circumferential surface of the tube insertion portion 5*a* and an outer circumferential surface of the trunkline delay detonator 2.

However, the connector 5 for a conventional blast-triggering device has a problem in that the connector 5 does not maintain the shape thereof during detonation of the trunkline delay detonator 2, and explodes, generating large amounts of debris.

Further, the connector 5 for a conventional blast-triggering device has a problem in that the connector does not maintain the shape thereof after detonation and is damaged, causing damage to the shock tubes 1 to generate a cut-off phenomenon (disconnection, blast failure) of the shock tubes 1.

Further, because the upper end of the trunkline delay detonator 2 is formed to have a flat upper surface and the inner circumferential surface of the tube insertion portion 5*a* is a flat surface corresponding to the flat upper surface of the trunkline delay detonator 2, a gap is formed between the trunkline delay detonator 2 and the shock tubes 1, and thus shock waves are not uniformly applied to the shock tubes during detonation of the detonator.

The trunkline delay detonator 2 uses a sensitive and powerful explosive like lead azide (LA). Thus, detonation debris flies out during detonation, and the debris cuts off (disconnects, fails to blast) a shock tube of an adjacent detonator that is provided to detonate an explosive. Thereby, the detonator connected to the cut shock tube fails to detonate.

That is, a gap is formed between the surface of the detonator and the shock tubes in contact therewith, thus causing energy loss, and thus a large quantity of a powerful explosive is necessarily used in order to compensate for the energy loss.

Since an edge of the upper end of the trunkline delay detonator 2 on which the shock tubes are disposed has an angular shape, the shock tubes are disposed asymmetrically, whereby shock waves are not uniformly transmitted thereto.

An explosive used in the trunkline delay detonator 2 includes heavy metals such as lead, causing environmental pollution during manufacture and upon use.

DISCLOSURE

Technical Problem

Accordingly, the present disclosure has been made keeping in mind the above problems occurring in the prior art, and an object of the present disclosure is to provide a trunkline delay detonator, wherein closeness of contact with a shock tube is improved, thereby reducing energy loss during detonation, and an explosive that is less sensitive and less powerful than a conventionally used explosive is used in order to ensure that an explosion signal is stably and uniformly applied to the shock tubes.

Another object of the present disclosure is to provide a blast-triggering device configured to maintain the shape of a connector during detonation in order to minimize the generation of debris.

Technical Solution

In order to accomplish the above object, the present disclosure provides a trunkline delay detonator, configured such that a plurality of shock tubes is in contact with a surface thereof, the plurality of shock tubes being connected to a detonator for initiating an explosive so that an explosion signal is applied to the plurality of shock tubes by detonation of the trunkline delay detonator. The trunkline delay detonator includes: a detonator casing member having an insertion space therein in a longitudinal direction thereof, the insertion space having an open lower end; a base charge member inserted into an upper end side of the insertion space in the detonator casing member; a delay line member inserted into the insertion space in the detonator casing member and positioned under the base charge member, and in which an ignition retardant is provided; a plug line member inserted into the insertion space in the detonator casing member and positioned under the delay line member; and a detonation tube inserted into an inside of the plug line member so that one end of the detonation tube is positioned up to an upper end of the plug line member, and in which an explosive is inserted.

An upper end of the detonator casing member may be formed in a hemispherical shape around a central upper flat surface of the detonator casing member.

An external diameter of the detonator casing member may be 7.1~8.5 mm, and an internal diameter thereof may be 5.5~7.0 mm.

The base charge member may include one explosive selected from among tricinate (lead tricinate), diazodinitrophenol (DDNP), tetracene, and mercury fulminate.

The base charge member may use an explosive selected from among explosives each having one value of falling hammer sensitivity and friction sensitivity equal to or higher than a corresponding value of lead azide (LA) and a remaining value thereof higher than a corresponding value of LA, thereby being less sensitive and less powerful than LA.

The trunkline delay detonator may include: a powder removal plate member, which may be positioned at an upper end of the delay line member, have a center hole, and be configured such that an outer circumference thereof may be in contact with an inner circumferential surface of the detonator casing member to remove base charge powder remaining on the inner circumferential surface thereof.

In order to accomplish the above object, the present disclosure provides A blast-triggering device may include: a connector; and a trunkline delay detonator, wherein the trunkline delay detonator is inserted into the connector, a plurality of shock tubes that are connected to a detonator for igniting an explosive is fitted between the connector and the trunkline delay detonator, and an explosion signal is applied to the shock tubes by detonation of the trunkline delay detonator. The connector may include: a connector body having a rectangular rod shape including front and rear surfaces and opposite side surfaces, and having therein a detonator insertion portion, which passes through the connector body in a longitudinal direction of the connector body, so that the trunkline delay detonator is inserted into the detonator insertion portion; a connector head configured such that a rear end thereof is integrally connected with a rear surface of the connector body, an upper surface thereof is formed in a curved surface extending from the rear end thereof to a front end thereof, a tube insertion portion of a void is provided between a lower surface thereof and the connector body so that the plurality of shock tubes connected to the detonator for igniting an explosive is fitted therein, and the front end thereof is separated from the connector body; a clip-fixing body, which is integrally provided with a lower end of the connector body, is formed by protruding from a circumference of the lower end of the connector body, has an opening of the detonator insertion portion in a lower surface thereof, and has a clip-fitting portion formed by passing through opposite side surfaces of the clip-fixing body; and a fixing clip fitted in the clip-fitting portion to fix the trunkline delay detonator that is inserted into the detonator insertion portion. The trunkline delay detonator may include: a detonator casing member having an insertion space therein in a longitudinal direction thereof, the insertion space having an open lower end; a base charge member inserted into an upper end side of the insertion space of the detonator casing member; a delay line member inserted into the insertion space in the detonator casing member and positioned under the base charge member, and in which an ignition retardant is provided; a plug line member inserted into the insertion space in the detonator casing member and positioned under the delay line member; and a detonation tube inserted into an inside of the plug line member so that one end of the detonation tube is positioned up to an upper end of the plug line member, and in which an explosive is inserted.

An upper end of the detonator casing member may be formed in a hemispherical shape around a central upper flat surface of the detonator casing member.

An external diameter of the detonator casing member may be 7.1~8.5 mm and an internal diameter thereof may be 5.5~7.0 mm.

The base charge member may include one explosive selected from among tricinate, diazodinitrophenol (DDNP), tetracene, and mercury fulminate.

The base charge member may use one explosive selected from among explosives each having one value selected from among falling hammer sensitivity and friction sensitivity equal to or less than a corresponding value of lead azide (LA) and a remaining value thereof less than a corresponding value of LA, thereby being less sensitive and less powerful than LA.

The trunkline delay detonator further may include: a powder removal plate member, which is positioned at an upper end of the delay line member, has a center hole therein, and is configured such that an outer circumference thereof is in contact with an inner circumferential surface of the detonator casing member to remove base charge powder remaining on the inner circumferential surface thereof.

The connector body, the connector head, and the clip-fixing body may be integrally formed in a single body, and be each made by using one material or mixing at least two materials selected from among high-density polyethylene, intermediate-density polyethylene, polypropylene, metallocene linear low-density polyethylene, and polyamide.

The lower surface of the connector head may be formed to have a flat surface corresponding to the central upper flat surface of the detonator casing member and a round surface corresponding to the hemispherical shape thereof.

The connector body may include: a main body member having a rectangular rod shape; and a head-supporting member provided at an upper end of the main body member, formed by extending outwards from a circumference of the main body member, and formed such that a rear surface thereof is integrally connected with the connector head and a front surface thereof is separated from a front end of the connector head, wherein the head-supporting member may have a guide protrusion at the front surface thereof, and the guide protrusion may be configured to be in contact with the front end of the connector head and be formed such that a gap between the guide protrusion and the connector head may widen from a contact portion with the connector head toward the front end of the connector head.

The main body member may be provided with a first horizontal groove and a second horizontal groove spaced apart from each other in a front surface thereof, the first horizontal groove and the second horizontal groove being open toward opposite sides of the main body member, respectively, a plurality of first horizontal grooves being spaced apart from each other in a longitudinal direction of the main body member, and a plurality of second horizontal grooves being spaced apart from each other in the longitudinal direction of the main body member, and the main body member may be provided with a third horizontal groove and a fourth horizontal groove spaced apart from each other in a rear surface thereof, the third horizontal groove and the fourth horizontal groove being open toward the opposite sides of the main body member, respectively, a plurality of third horizontal grooves being spaced apart from each other in the longitudinal direction of the main body member, and a plurality of fourth horizontal grooves being spaced apart from each other in the longitudinal direction of the main body member.

An upper surface of the connector body may be provided with side protrusions for supporting tubes, the side protrusions for supporting tubes protruding into the tube insertion portion to be spaced apart from each other, receiving an upper end of the trunkline delay detonator therebetween, and each having a semicircular shape when viewed from a lateral direction of the connector body.

The fixing clip may be provided with a tube-fitting groove in which the detonation tube connected to the trunkline delay detonator may be fitted, so that a lower end of the trunkline delay detonator may be supported when the detonation tube is inserted into and fitted in the tube-fitting groove.

A total length including the connector body, the connector head, and the clip-fixing body may be 65~110 mm, and a thickness between opposite side surfaces of the connector body may be 15~50 mm, a diameter of the detonator insertion portion may be 7.1~9.5 mm, a thickness between the upper surface and the lower surface of the connector head may be 3~15 mm, and a gap between the lower surface of the connector head and an outer upper circumferential surface of the side protrusion for supporting tubes may be 2.5~4.5 mm.

Advantageous Effects

As described above, the present disclosure is configured such that closeness of contact with the shock tube is improved, thereby reducing energy loss during detonation, and an explosive that is less sensitive and less powerful than a conventional explosive is used.

Accordingly, an explosion signal can be stably and uniformly applied to a shock tube.

The present disclosure is configured such that an explosive that is less sensitive and less powerful than a conventional explosive is used. Thus, a cut-off phenomenon of another shock tube during detonation is prevented and detonation reliability can be improved.

The present disclosure enables use of an explosive not containing heavy metals, so that environmental pollution during manufacture or use thereof can be prevented.

The present disclosure is configured to maintain the shape of a connector during detonation in order to minimize the generation of debris, so that safety during detonation can be improved.

The present disclosure is configured to maintain the shape of the connector so as to prevent damage, due to the debris, from occurring to a plurality of shock tubes connected to the detonator for initiating an explosive, so that the cut-off phenomenon due to the damage of the shock tubes during detonation can be prevented and detonation reliability can be improved.

DESCRIPTION OF REFERENCE NUMERALS

Figure 1:
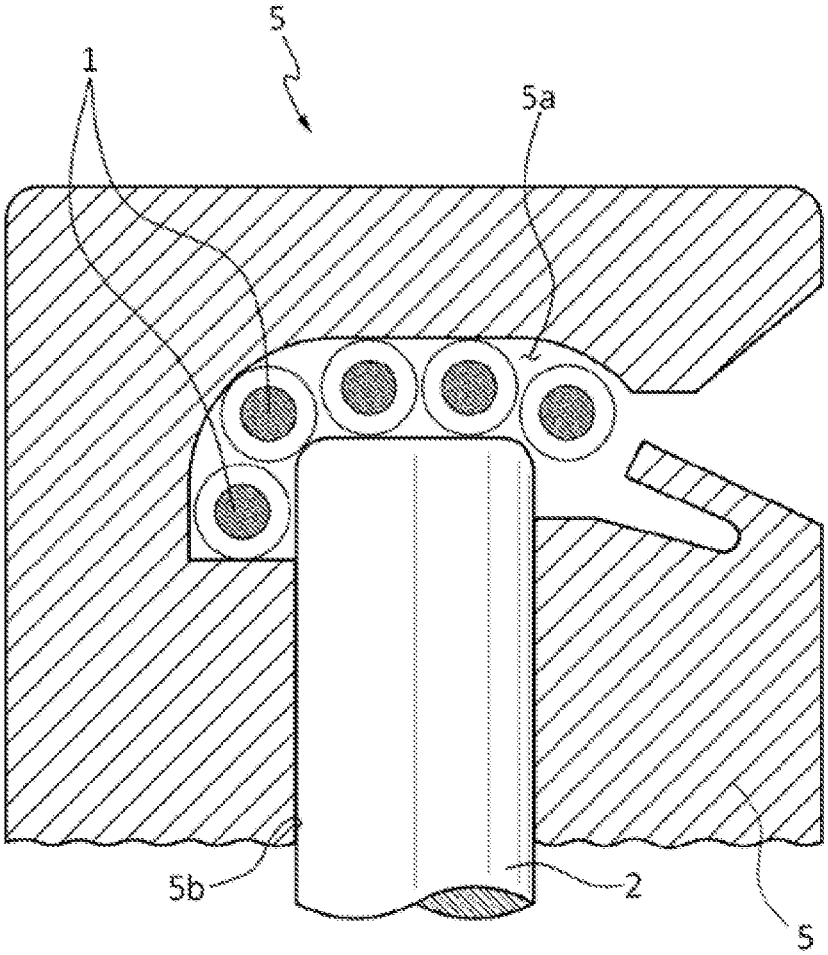
FIG. 1 (Prior Art)
FIG. 1 is a schematic view showing a connector for a conventional blast-triggering device.

1: shock tube
2: trunkline delay detonator
10: detonator casing member
20: base charge member
30: delay line member
31: ignition retardant
40: plug line member
50: detonation tube
60: powder removal plate member
100: connector body
101: detonator insertion portion
110: main body member
111: first horizontal groove
112: second horizontal groove
113: third horizontal groove
114: fourth horizontal groove
120: head-supporting member
121: guide protrusion
130: side protrusion for supporting tubes
200: connector head
**200*a***: tube insertion portion
210: head protrusion
300: clip-fixing body
310: clip-fitting portion
400: fixing clip
410: tube-fitting groove

BEST MODE

Hereinafter, the present disclosure will be described in detail with reference to the accompanying drawings. In the following description, when the detailed description with respect to the functions of conventional elements and the configuration thereof may make the gist of the present disclosure unclear, the detailed description thereof will be omitted. The embodiment of the present disclosure is provided to enable those skilled in the art to more clearly comprehend the present disclosure. Therefore, it should be understood that the shape and size of the elements shown in the drawings may be exaggeratedly illustrated in order to provide an easily understood description of the structure of the present disclosure.

Figure 2:
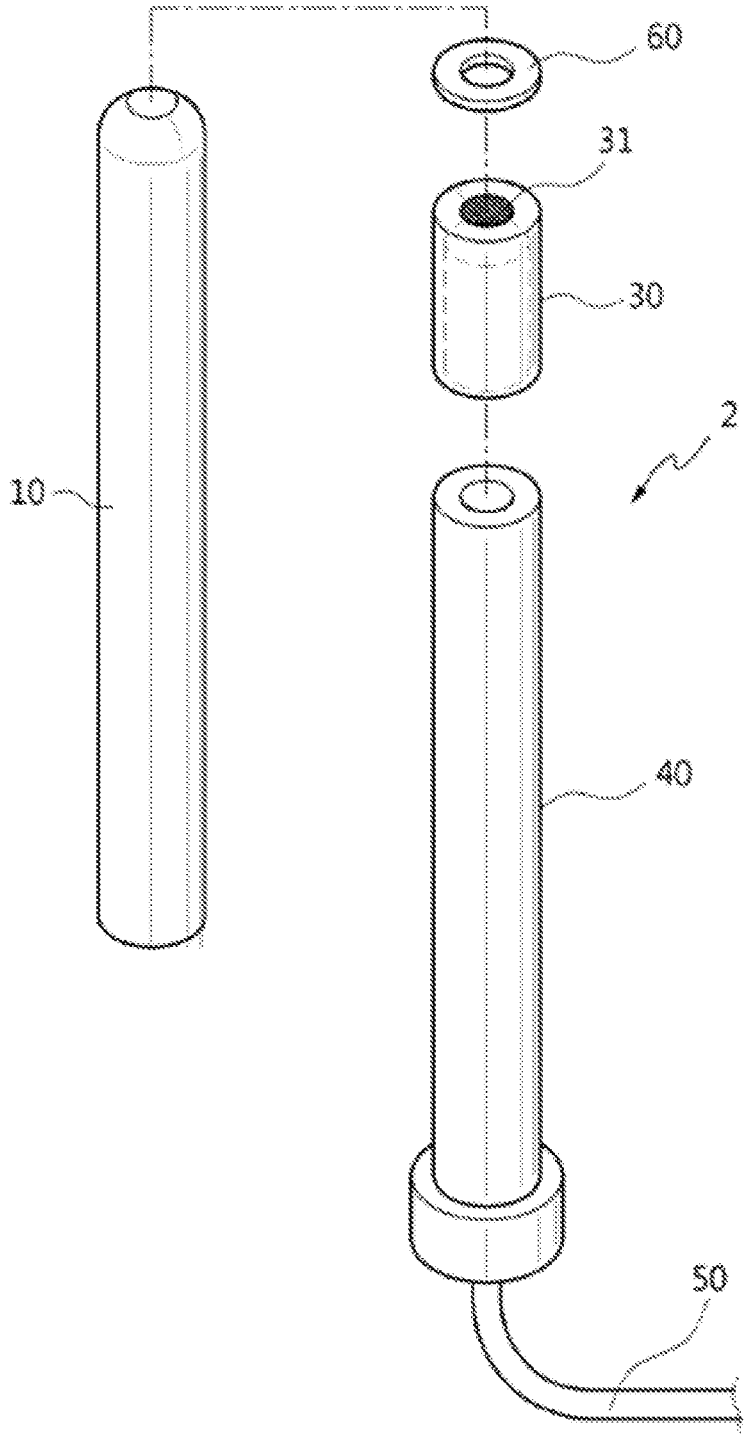
FIG. 2 is an exploded perspective view showing a trunkline delay detonator according to the present disclosure.
Figure 3:
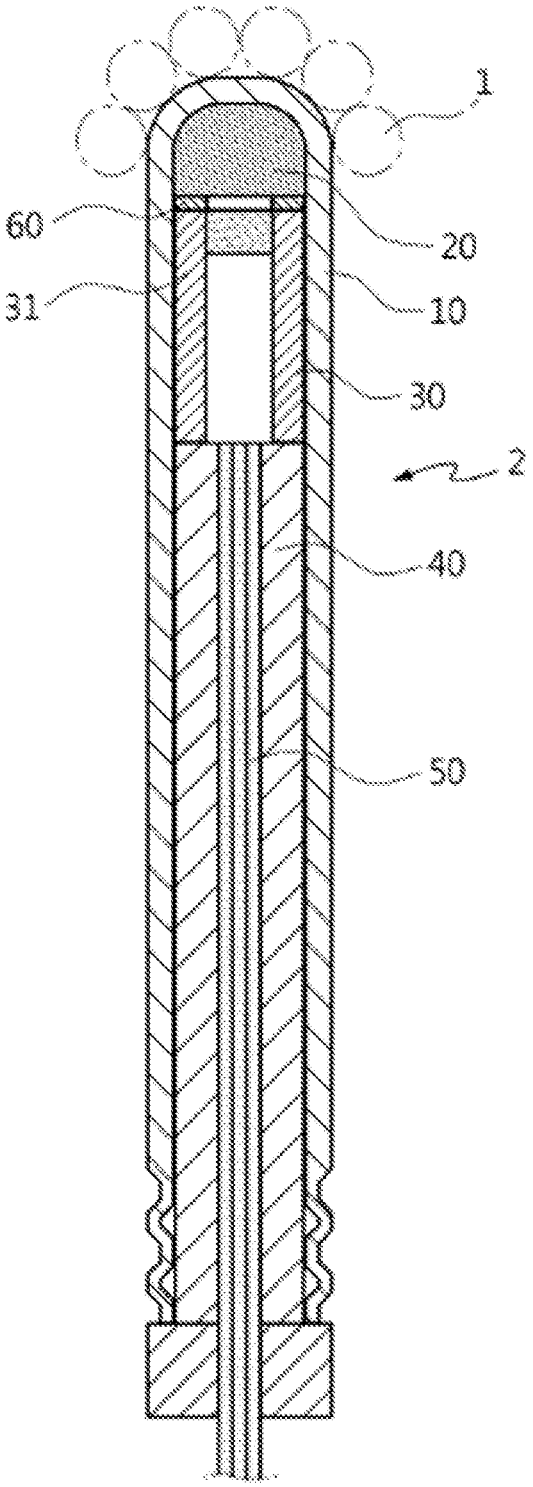
FIG. 3 is a sectional view showing the trunkline delay detonator according to the present disclosure.

FIG. 2 is an exploded perspective view of a trunkline delay detonator 2 according to the present disclosure; and FIG. 3 is a sectional view showing the trunkline delay detonator 2 according to the present disclosure. As an example, the trunkline delay detonator 2 according to the present disclosure is configured to detonate while being in contact with a plurality of shock tubes connected to a detonator for initiating an explosive in order to apply an explosion signal to the shock tubes.

Referring to FIGS. 2 and 3, the trunkline delay detonator 2 of the present disclosure includes a detonator casing member 10. The detonator casing member 10 has an insertion space therein in the longitudinal direction thereof, the insertion space having an open lower end. An upper end of the detonator casing member 10 is formed in a hemispherical shape around a central flat surface to improve closeness of contact with the shock tubes that are in contact with the outer surface of the upper end of the detonator casing member 10.

A base charge member 20 is inserted into the insertion space in the detonator casing member 10 so as to be positioned at the uppermost end of the insertion space.

An outer diameter of the detonator casing member 10 may be 7.1~8.5 mm, and an inner diameter thereof may be 5.5~7.0 mm. The ranges of the outer and inner diameters serve to effectively transmit shock waves, generated during detonation, to the shock tubes and to improve detonation reliability.

The upper end of the detonator casing member 10 is formed in a hemispherical shape around the central flat surface thereof to improve the closeness of contact with the shock tubes that are in contact with the outer surface of the upper end thereof. Therefore, as the base charge member 20, explosives that are less sensitive and less powerful than conventional sensitive explosives such as lead azide (LA) and high explosives such as pentaerythritol tetranitrate (PETN) may be used.

As an example, the base charge member 20 may include one explosive among tricinate (lead tricinate), diazodinitrophenol (DDNP), tetracene, and mercury fulminate, and may be manufactured without heavy metals such as lead.

The base charge member 20 may include one among explosives in which one value among falling hammer sensitivity and friction sensitivity is equal to or higher than that of LA, and a remaining value is higher than that of LA, meaning that the explosives are less sensitive and less powerful.

Further, since explosives including LA include lead, it is more preferable that the base charge member 20 be an explosive not containing heavy metals such as lead, among explosives in which one value among falling hammer sensitivity and friction sensitivity is equal to or higher than that of LA and the remaining value is higher than that of LA, so that the explosive is less sensitive and less powerful.

Table 1 as below shows sensitivities of explosives. As an example in the present disclosure, the base charge member 20 is DDNP.

TABLE 1

| Explosive | Anti-static performance (kV) | Ignition point (° C.) | Falling hammer sensitivity (cm) | Friction sensitivity (kgf) | note |
|---|---|---|---|---|---|
| DDPN | 20 | 162 | 5 | 1 | Embodiment |
| PETN | 12 | 262 | 10 | 5.6 | Comparative example |
| LA | 4 | 285 | 5 | 0.2 | Comparative example |
| LS | 1 | 340 | 30 | 1.4 | |
| RDX | 20 | 340 | 13 | 14.4 | |
| HMX | | 295 | 25 | 9.6 | |

A delay line member 30 is inserted into the insertion space in the detonator casing member 10, and the delay line member 30 may be positioned under the base charge member 20, and may be provided with an ignition retardant 31 therein to delay ignition of the base charge member 20.

The ignition retardant 31 is positioned up to an upper portion in the delay line member 30 and is disposed as close as possible to the base charge member 20. The extent of insertion of the ignition retardant 31 is adjusted to set the ignition time of the base charge member 20.

A plug line member 40 is inserted into the insertion space in the detonator casing member 10 in order to support the lower portion of the delay line member 30 to thus fix the position of the delay line member 30.

A detonation tube 50 is inserted into the plug line member 40.

The delay line member 30 is coupled to the upper end of the plug line member 40. As an example, the plug line member 40 is made of rubber, and may be made of various materials having elasticity like rubber.

The detonation tube 50 is inserted into the plug line member 40 such that one end of the detonation tube 50 is positioned up to the upper end of the plug line member 40.

The detonation tube 50 stores an explosive therein. An upper end of the detonation tube 50 is inserted to a position in the upper end of the plug line member 40, the position allowing the detonation tube 50 to ignite the ignition retardant 31 or the base charge member 20.

As an example, the detonation tube 50 is configured to ignite the explosive therein in order to detonate the base charge member 20 using the ignition retardant 31 in the delay line member 30. When the ignition retardant 31 is excluded from the configuration, the detonation tube 50 may ignite the base charge member 20 directly.

Meanwhile, the trunkline delay detonator 2 according to the present disclosure preferably includes a powder removal plate member 60. The powder removal plate member 60 is positioned at the upper end of the delay line member 30, has a center hole therein, and is configured such that the outer circumference thereof is in contact with the inner circumferential surface of the detonator casing member 10 to remove the base charge powder remaining on the inner circumferential surface thereof.

When the base charge member 20 is provided with the base charge powder in the detonator casing member 10, the base charge powder may remain on the inner circumferential surface of the detonator casing member 10. The remaining powder on the inner circumferential surface of the detonator casing member 10 may entail the risk of explosion due to friction during manufacture and the risk of irregular explosion during detonation.

The delay line member 30 is coupled to the upper end of the plug line member 40, and is inserted into the detonator casing member 10 together with the plug line member 40. Further, the powder removal plate member 60 is provided at the upper end of the delay line member 30 to remove the base charge powder remaining on the inner circumferential surface of the detonator casing member 10.

As an example, the powder removal plate member 60 is made of a paper material. The powder removal plate member 60 has a shape enabling close contact with the inner circumferential surface of the detonator casing member 10. Accordingly, when the delay line member 30 and the plug line member 40 are inserted into the detonator casing member 10, the powder removal plate member 60 is moved from the lower end of the detonator casing member 10 to the upper end thereof while in close contact with the inner circumferential surface of the detonator casing member 10, so that the base charge powder remaining on the inner circumferential surface of the detonator casing member 10 is removed from the inner circumferential surface by the powder removal plate member 60.

The powder removal plate member 60 removes the base charge powder remaining on the inner circumferential surface of the detonator casing member 10 to prevent irregular explosion due to the remaining base charge powder.

The trunkline delay detonator 2 of the present disclosure is configured to improve closeness of contact with the shock tubes, so that energy loss during detonation can be reduced. Further, the trunkline delay detonator 2 uses an explosive having relatively less sensitivity and less power than conventional explosives, so that an explosion signal can be stably and uniformly applied to the shock tubes.

The trunkline delay detonator 2 of the present disclosure uses an explosive having relatively less sensitivity and less power than conventional explosives to prevent a cut-off phenomenon of the shock tubes during detonation. Therefore, detonation reliability can be improved.

The trunkline delay detonator 2 of the present disclosure uses an explosive not containing heavy metals, so that environmental pollution can be prevented during manufacture and use.

Figure 4:
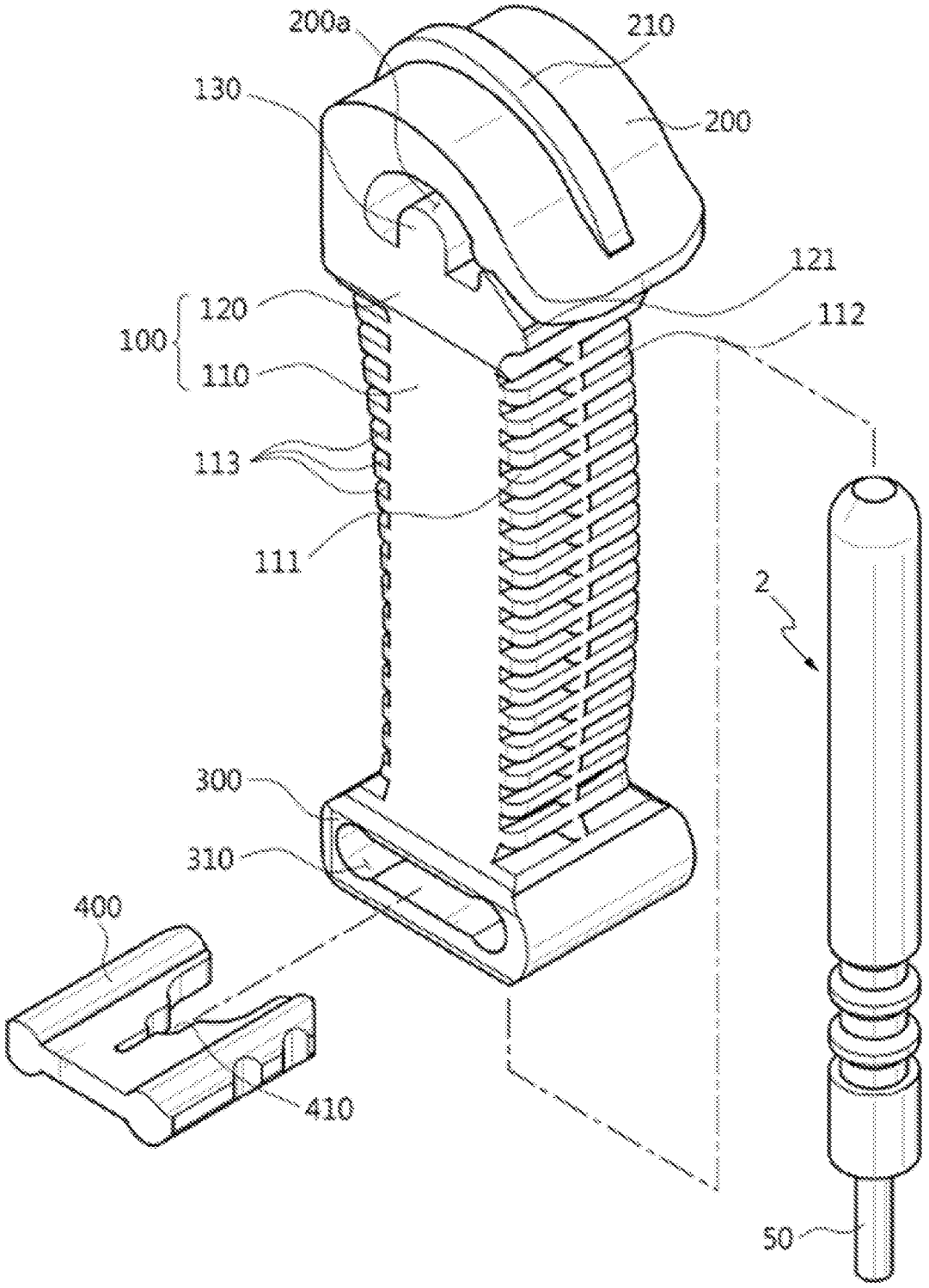
FIG. 4 is an exploded perspective view showing a blast-triggering device according to the present disclosure.

FIG. 4 is an exploded perspective view showing a blast-triggering device according to the present disclosure. Referring to FIG. 4, the blast-triggering device of the present disclosure is configured such that the trunkline delay detonator 2 is inserted into a connector 3, a plurality of shock tubes connected to the detonator for initiating an explosive is fitted between the connector 3 and the trunkline delay detonator 2, and an explosion signal is applied to the shock tubes by detonation of the trunkline delay detonator 2.

Referring to FIG. 4, the connector 3 includes: a connector body 100 having a rectangular rod shape including front and rear surfaces and opposite side surfaces, and having a detonator insertion portion 101 therein, which is formed by passing through the connector body in the longitudinal direction of the connector body 100, so that the trunkline delay detonator 2 is inserted therein; a connector head 200 configured such that the rear end thereof is integrally connected to a rear surface of the connector body 100, an upper surface thereof has a curved shape extending from the rear end thereof to a front end thereof, a tube insertion portion 200*a* of a void is formed between a lower surface and the connector body 100 so that the plurality of shock tubes 1 connected to the detonator for initiating an explosive is fitted, and a front end thereof is separated from the connector body 100; a clip-fixing body 300 integrally provided as a single body together with a lower end of the connector body 100, having a shape protruding from the circumference of the connector body 100, having an opening of the detonator insertion portion 101 in the lower surface thereof, and having a clip-fitting portion 310 formed by passing through opposite side surfaces of the clip-fixing body; and a fixing clip 400 fitted in the clip-fitting portion 310 and coupled thereto to fix the trunkline delay detonator 2, which is inserted into the detonator insertion portion 101.

Further, the trunkline delay detonator 2 includes: the detonator casing member 10, having an insertion space therein in the longitudinal direction thereof, the insertion space having an open lower end; the base charge member 20 inserted into the upper end of the insertion space of the detonator casing member 10; the delay line member 30, which is inserted into the insertion space in the detonator casing member 10 and is positioned under the base charge member 20, and in which the ignition retardant 31 is provided; the plug line member 40 inserted into the insertion space in the detonator casing member 10 and positioned under the delay line member 30; and the detonation tube 50 inserted into the plug line member 40 so that one end thereof is positioned up to the upper end of the plug line member 40, and in which an explosive is inserted.

Figure 5:
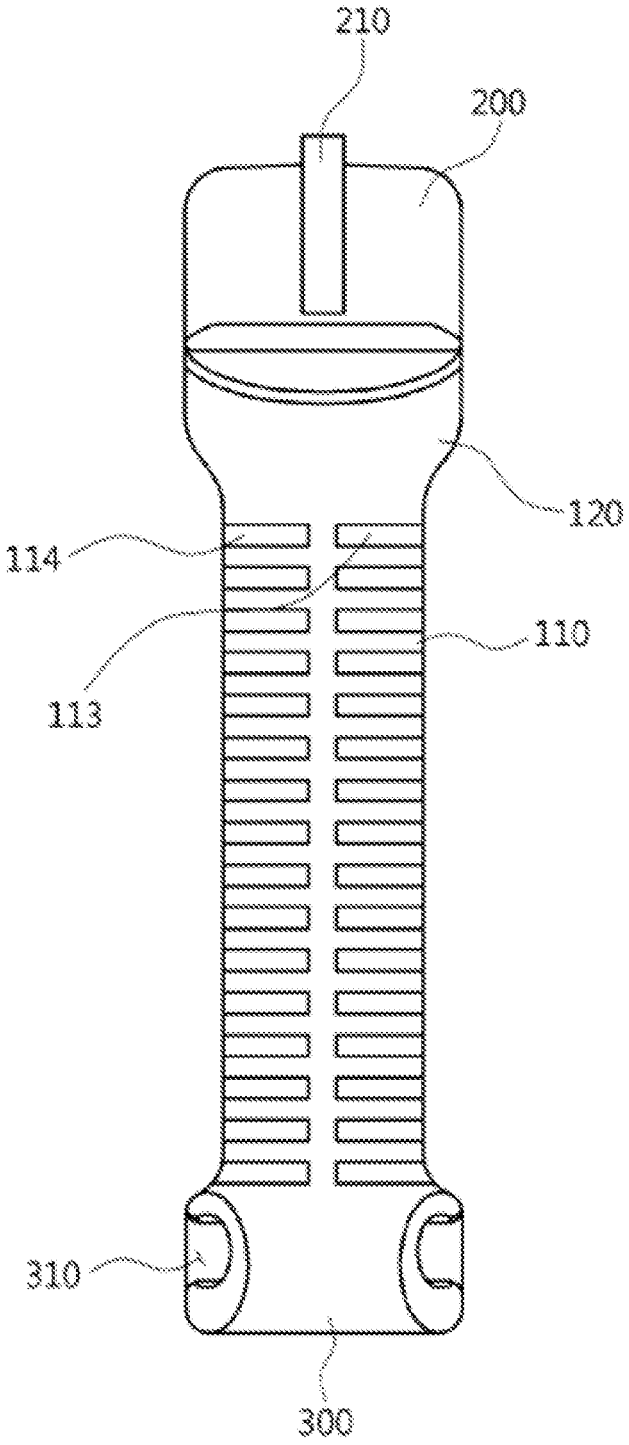
FIG. 5 is a rear view showing a connector of the blast-triggering device according to the present disclosure.
Figure 6:
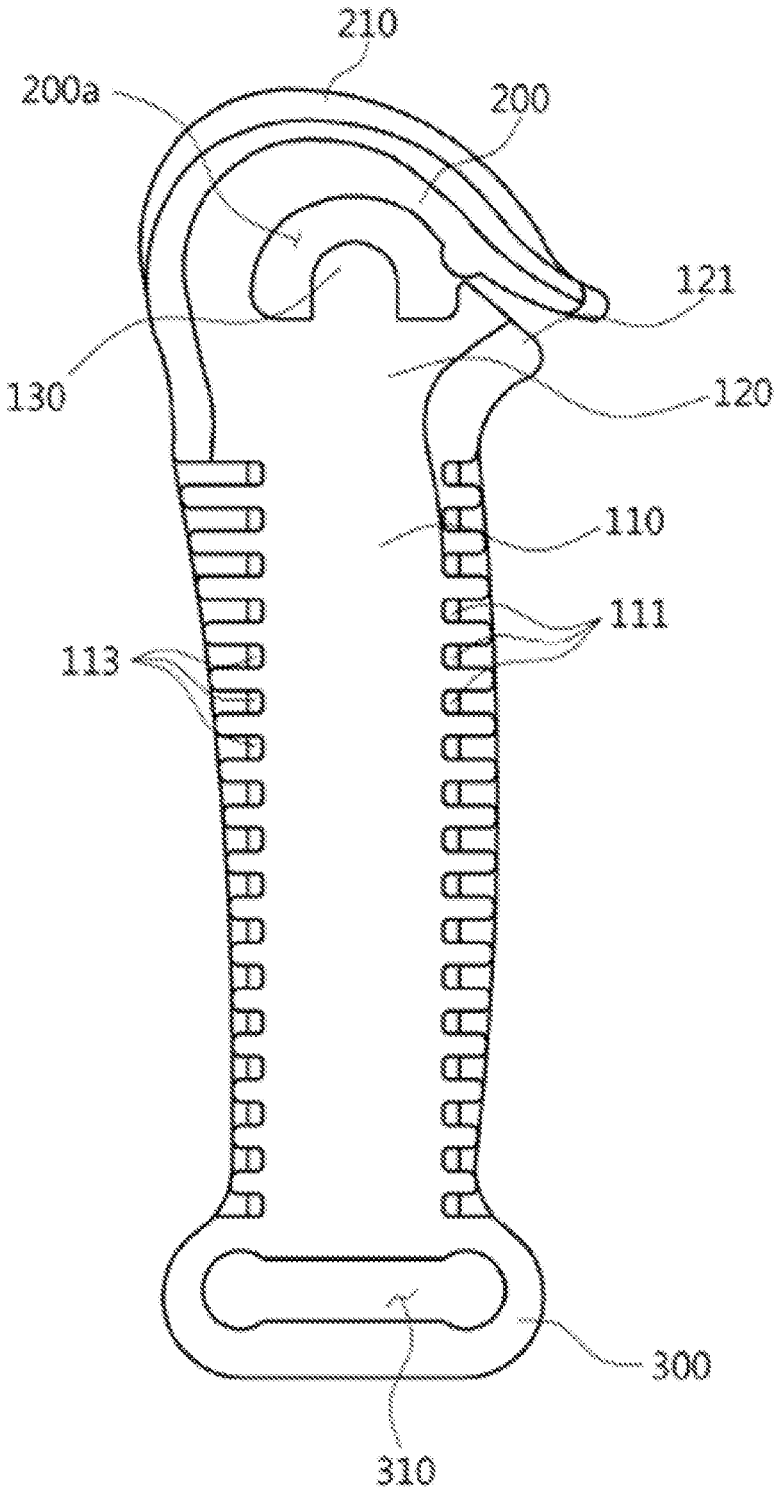
FIG. 6 is a side view showing the connector of the blast-triggering device according to the present disclosure.
Figure 7:
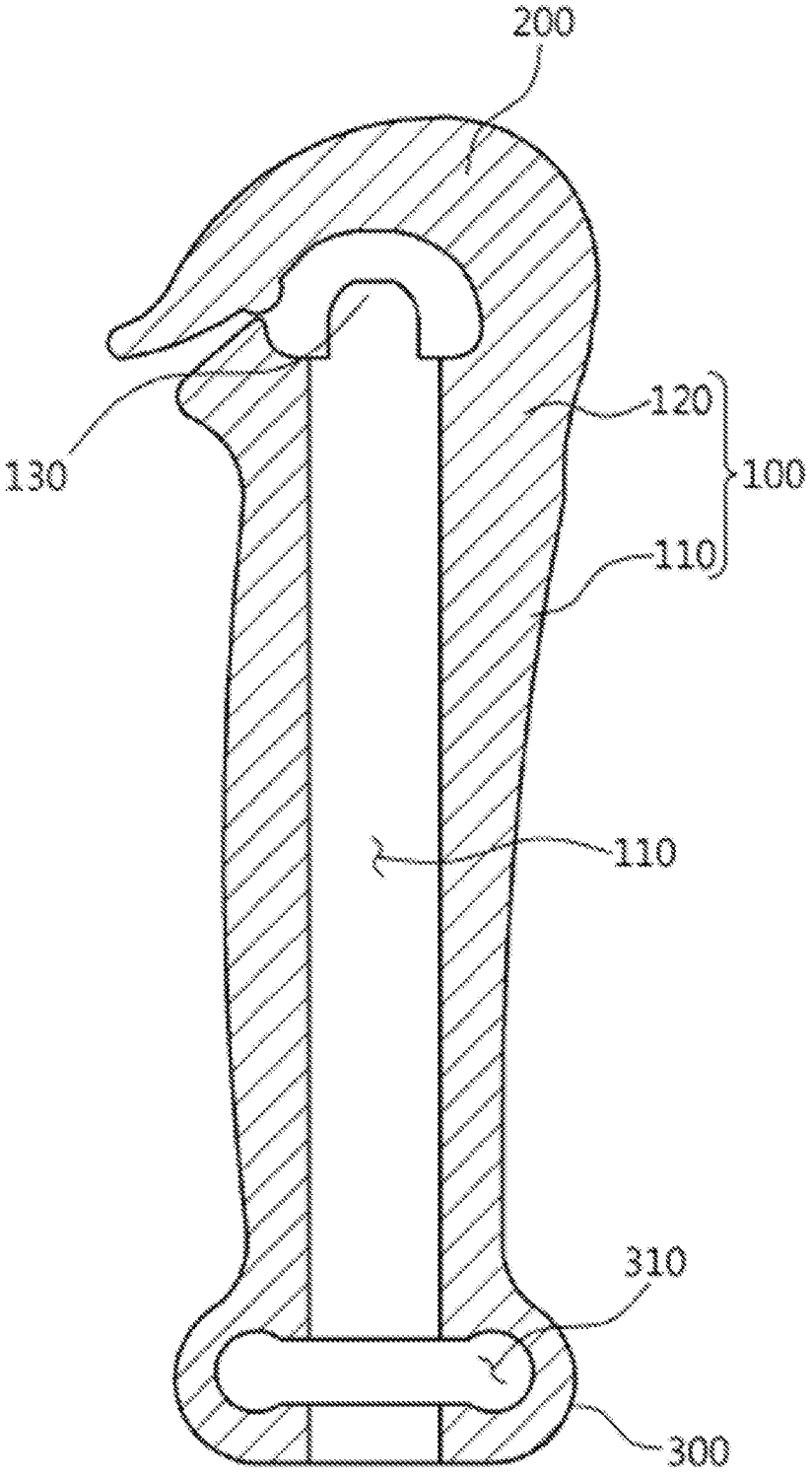
FIG. 7 is a sectional view showing the connector of the blast-triggering device according to the present disclosure.
Figure 8:
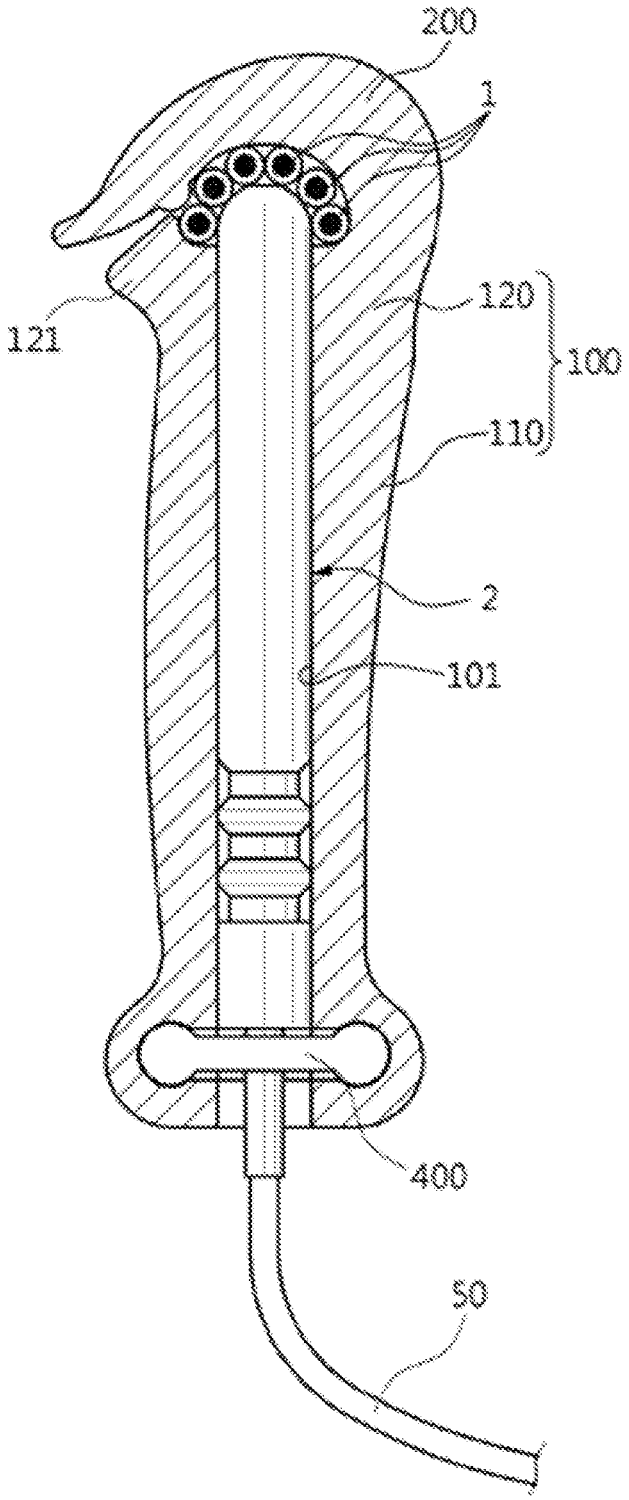
FIG. 8 is a sectional view showing the blast-triggering device according to the present disclosure.

Further, FIG. 5 is a rear view showing the connector of the blast-triggering device according to the present disclosure; FIG. 6 is a side view showing the connector of the blast-triggering device according to the present disclosure; FIG. 7 is a sectional view showing the connector of the blast-triggering device according to the present disclosure; and FIG. 8 is a sectional view showing the blast-triggering device according to the present disclosure.

The embodiment of the trunkline delay detonator 2 has been described above, so a redundant description thereof will be omitted.

Referring to FIGS. 5 to 8, the connector body 100, the connector head 200, and the clip-fixing body 300 are integrally formed into a single body, and each is made by using one material or mixing at least two materials of high-density polyethylene, intermediate-density polyethylene, polypropylene, metallocene linear low-density polyethylene, and polyamide, or may be made of any known synthetic resin material.

The connector body 100 has the rectangular rod shape including the front and rear surfaces and the opposite side surfaces. The detonator insertion portion 101 is formed so as to pass through the inside of the connector body 100 in the longitudinal direction thereof for insertion of a detonator therein. The trunkline delay detonator 2 is inserted into the detonator insertion portion 101, and detonates to apply the explosion signal to the plurality of shock tubes 1.

The rear end of the connector head 200 is integrally connected to the rear upper surface of the connector body 100. The upper surface of the connector head 200 is has a curved shape by extending from the rear end of the connector head 200 to the front end thereof, and the front end thereof is separated from the connector body 100.

Further, between the lower surface of the connector head 200 and the connector body 100, the tube insertion portion 200*a* is formed by passing through the connector in opposite side directions of the connector body 100, so that the plurality of shock tubes 1 connected to the detonator for initiating an explosive is fitted therein.

The connector body 100 includes: a main body member 110 having a rectangular rod shape; and a head-supporting member 120 provided at an upper end of the main body member 110, formed by extending outwards from the circumference of the main body member 110, and formed such that the rear surface thereof is integrally connected with the connector head 200 and the front surface thereof is separated from the front end of the connector head 200.

The main body member 110 has a first horizontal groove 111 and a second horizontal groove 112 in the front surface thereof. The first horizontal groove 111 and the second horizontal groove 112 are spaced apart from each other on the basis of the center of the front surface thereof, and are open in opposite side directions of the main body member 110. The first horizontal groove 111 and the second horizontal groove 112 are each provided in a plural number, the first horizontal grooves 111 are spaced apart from each other in the longitudinal direction of the main body member 110, and the second horizontal grooves 112 are spaced apart from each other in the longitudinal direction of the main body member 110.

Further, the main body member 110 has a third horizontal groove 113 and a fourth horizontal groove 114 formed in the rear surface thereof. The third and fourth horizontal grooves 113 and 113 are space apart from each other on the basis of the center of the rear surface thereof, and are open in the opposite side directions of the main body member 110. The third and fourth horizontal grooves 113 and 113 are each provided in a plural number, the third horizontal grooves 113 are spaced apart from each other in the longitudinal direction of the main body member 110, and the fourth horizontal grooves 114 are spaced apart from each other in the longitudinal direction of the main body member 110.

The first horizontal grooves 111 and the second horizontal grooves 112, and the third horizontal grooves 113 and the fourth horizontal grooves 114, formed in the front and rear surfaces of the main body member 110, respectively, are provided to increase the rigidity of the main body member 110. Thereby, damage to the main body member 110 is prevented when the trunkline delay detonator 2 detonates in the detonator insertion portion 101, and usability is increased.

The head-supporting member 120 is provided with a guide protrusion 121 on the front surface thereof, the guide protrusion 121 being in contact with the front end of the connector head 200. The guide protrusion 121 is formed such that a gap between the guide protrusion 121 and the connector head 200 widens from the contact portion with the connector head 200 toward the front end of the connector head 200.

The gap between the front end of the connector head 200 and the guide protrusion 121 has a form that gradually narrows from an opening of the gap toward the inside thereof. Accordingly, the plurality of shock tubes 1 may be easily inserted into the tube insertion portion 200*a* by lifting the connector head 200 upwards at the opening and then widening a void space of the tube insertion portion 200*a* formed between the connector head 200 and the connector body 100, that is, the head-supporting member 120.

Opposite side surfaces of the connector head 200 may be formed as flat surfaces.

Further, the connector head 200 may have a spherical shape in which all of upper and opposite side surfaces are curved.

The connector head 200 is preferably provided with a head protrusion 210 on the upper surface thereof. The head protrusion 210 is formed so as to extend from the rear end of the connector head to the front end thereof.

The head protrusion 210 protrudes from the center of the upper surface of the connector head 200, and has a curved upper end corresponding to the curved upper surface of the connector head 200.

The head protrusion 210 increases the rigidity of the connector head 200 in order to prevent the connector head 200 from being damaged when the trunkline delay detonator 2 detonates in the detonator insertion portion 101.

The upper end of the trunkline delay detonator 2 is formed in a hemispherical shape around the central upper flat surface thereof, and the lower surface of the connector head 200 is formed to have a flat surface corresponding to the flat surface of the trunkline delay detonator 2 and a curved surface corresponding to the hemispherical shape thereof, so that the plurality of shock tubes 1 is fitted between the outer circumferential surface of the trunkline delay detonator 2 and the lower surface of the connector head 200.

Further, the curved surface of the lower surface of the connector head 200 is preferably formed in a semicircular shape that is the same as the hemispherical shape of the trunkline delay detonator 2 protruding into the tube insertion portion 200*a*.

Thus, between the upper end of the trunkline delay detonator 2 and the upper surface of the tube insertion portion 200*a*, the plurality of shock tubes 1 having the same diameter may be in uniform contact with the outer circumferential surface of the upper end of the trunkline delay detonator 2.

Further, side protrusions 130 for supporting tubes are provided on the upper surface of the connector body 100. The side protrusions 130 for supporting tubes are formed by protruding into the tube insertion portion 200*a* to be spaced apart from each other, and the upper end of the trunkline delay detonator 2 is disposed therebetween.

Each of the side protrusions 130 for supporting tubes is a protrusion having a semicircular shape when viewed from a lateral direction of the connector body 100, and may have the same radius as the hemispherical shape of the upper end of the trunkline delay detonator 2.

The side protrusions 130 for supporting tubes are disposed at opposite sides of the upper end of the trunkline delay detonator 2 protruding into the tube insertion portion 200*a*. The side protrusions 130 for supporting tubes are each formed to surround a portion of the outer circumferential surface of the upper end of the trunkline delay detonator 2.

The side protrusions 130 for supporting tubes serve to make the connector head 200 more resistant to shocks when the trunkline delay detonator 2 detonates in the detonator insertion portion 101. Thus, the connector head 200 can maintain the shape thereof, and scattering of debris in the detonator insertion portion 101 during detonation can be prevented.

The side protrusions 130 for supporting tubes support the shock tubes 1 fitted into the tube insertion portion 200*a* to prevent the upper end of the trunkline delay detonator 2 from being displaced in position while being depressed downward from the side protrusion 130 for supporting tubes. Further, the side protrusions 130 for supporting tubes allow the upper end of the trunkline delay detonator 2 to be positioned at the same level as the upper ends of the side protrusions 130 for supporting tubes, so that the plurality of shock tubes 1 fitted in the tube insertion portion 200*a* can be fixed while being in uniform contact with the outer circumferential surface of the trunkline delay detonator 2.

The clip-fixing body 300 is integrally provided with the lower end of the connector body 100, and is formed by protruding from the circumference of the lower end of the connector body 100.

The clip-fixing body 300 has the opening of the detonator insertion portion 101 in the lower surface thereof, and the clip-fitting portion 310 is formed by passing through opposite side surfaces of the clip-fixing body 300.

The fixing clip 400 is fitted in the clip-fitting portion 310. The fixing clip 400 supports the lower end of the trunkline delay detonator 2 inserted into the detonator insertion portion 101 to fix the position of the trunkline delay detonator 2.

The fixing clip 400 is provided with a tube-fitting groove 410 into which the detonation tube 50 connected to the trunkline delay detonator 2 is fitted. As the detonation tube 50 is inserted into the tube-fitting groove 410, the fixing clip 400 supports the lower end of the trunkline delay detonator 2 to prevent the trunkline delay detonator 2 from being moved downwards in the longitudinal direction of the connector body 100.

Thus, when the detonation tube 50 is pulled at a blasting field, the upper end of the trunkline delay detonator 2 moves no further downwards from a contact position with the shock tubes 1 in the tube insertion portion 200*a*. Accordingly, the close contact state between the shock tubes 1 and the trunkline delay detonator 2 can be maintained.

It is preferable that a total length including the connector body 100, the connector head 200, and the clip-fixing body 300 be 65~110 mm.

The above length range serves to allow the connector body 100, the connector head 200, and the clip-fixing body 300 to maintain the shapes thereof during detonation of the trunkline delay detonator 2.

It is preferable that the thickness between the opposite side surfaces of the connector body 100 is 15~50 mm. The above thickness range serves to allow the connector body 100 to maintain the shape thereof during detonation of the trunkline delay detonator 2.

It is preferable that the diameter of the detonator insertion portion 101 be 7.1~9.5 mm. The above diameter range serves to allow the trunkline delay detonator 2 to be fixed in a fitted state in the detonator insertion portion 101, and to allow the connector body 100 to maintain the shape thereof during detonation of the trunkline delay detonator 2.

It is preferable that the thickness between the upper surface and the lower surface of the connector head 200 be 3~15 mm. The above thickness range serves to allow the connector head 200 to maintain the shape thereof during detonation of the trunkline delay detonator 2.

It is preferable that the gap between the lower surface of the connector head 200 and the outer upper circumferential surface of the side protrusion 130 for supporting tubes be 2.5~4.5 mm. The above gap range serves to allow the shock tubes 1 to be fixed in the uniform contact state with the outer circumferential surface of the trunkline delay detonator 2 and to allow the connector head 200 to maintain the shape thereof.

According to the present disclosure, the blast-triggering device is configured as follows. The trunkline delay detonator 2 is inserted into the detonator insertion portion 101 of the connector and protrudes into the tube insertion portion 200*a*, so that the upper end of the trunkline delay detonator 2 is positioned up to the same level as the upper end of the side protrusion 130 for supporting the tubes. Then, the plurality of shock tubes 1 is fitted into the tube insertion portion 200*a* and is brought into close contact with the outer circumferential surface of the trunkline delay detonator 2. Thereby, when the trunkline delay detonator 2 is detonated by igniting the base charge member 20 using the explosive in the detonation tube 50, shock waves generated during detonation are efficiently transmitted to the plurality of shock tubes 1.

The present disclosure is configured to maintain the shape of the connector during detonation to minimize debris. Accordingly, safety during detonation is improved.

The present disclosure is configured to maintain the shape of the connector during detonation to prevent damage to the shock tubes due to the debris, the shock tubes being connected to the detonator for initiating an explosive. Accordingly, a cut-off phenomenon attributable to damage to the shock tubes is prevented, and detonation reliability is improved.

Although a preferred embodiment of the present disclosure has been described for illustrative purposes, those skilled in the art will appreciate that various modifications, additions and substitutions are possible without departing from the scope and spirit of the invention as disclosed in the accompanying claims, and the scope of the present disclosure should be interpreted on the basis of the claims.

The invention claimed is:

1. A blast-triggering device comprising:

a connector; and a trunkline delay detonator, wherein the trunkline delay detonator is inserted into the connector, a plurality of shock tubes that are connected to a detonator for igniting an explosive is fitted between the connector and the trunkline delay detonator, and an explosion signal is applied to the shock tubes by detonation of the trunkline delay detonator, the connector comprises:

a connector body having a rectangular rod shape including front and rear surfaces and opposite side surfaces, and having therein a detonator insertion portion, which passes through the connector body in a longitudinal direction of the connector body, so that the trunkline delay detonator is inserted into the detonator insertion portion;

a connector head configured such that a rear end thereof is integrally connected with a rear surface of the connector body, an upper surface thereof is formed in a curved surface extending from the rear end thereof to a front end thereof, a tube insertion portion of a void is provided between a lower surface thereof and the connector body so that the plurality of shock tubes connected to the detonator for igniting an explosive is fitted therein, and the front end thereof is separated from the connector body;

a clip-fixing body, which is integrally provided with a lower end of the connector body, is formed by protruding from a circumference of the lower end of the connector body, has an opening of the detonator insertion portion in a lower surface thereof, and has a clip-fitting portion formed by passing through opposite side surfaces of the clip-fixing body; and a fixing clip fitted in the clip-fitting portion to fix the trunkline delay detonator that is inserted into the detonator insertion portion, and the trunkline delay detonator comprises:

a detonator casing member having an insertion space therein in a longitudinal direction thereof, the insertion space having an open lower end;

a base charge member inserted into an upper end side of the insertion space of the detonator casing member;

a delay line member inserted into the insertion space in the detonator casing member and positioned under the base charge member, and in which an ignition retardant is provided;

a plug line member inserted into the insertion space in the detonator casing member and positioned under the delay line member; and a detonation tube inserted into an inside of the plug line member so that one end of the detonation tube is positioned up to an upper end of the plug line member, and in which an explosive is inserted, wherein the connector body comprises:

a main body member having a rectangular rod shape; and a head-supporting member provided at an upper end of the main body member, formed by extending outwards from a circumference of the main body member, and formed such that a rear surface thereof is integrally connected with the connector head and a front surface thereof is separated from a front end of the connector head, wherein the head-supporting member has a guide protrusion at the front surface thereof, and the guide protrusion is configured to be in contact with the front end of the connector head and is formed such that a gap between the guide protrusion and the connector head widens from a contact portion with the connector head toward the front end of the connector head, wherein the main body member is provided with a first horizontal groove and a second horizontal groove spaced apart from each other in a front surface thereof, the first horizontal groove and the second horizontal groove being open toward opposite sides of the main body member, respectively, a plurality of first horizontal grooves being spaced apart from each other in a longitudinal direction of the main body member, and a plurality of second horizontal grooves being spaced apart from each other in the longitudinal direction of the main body member, and the main body member is provided with a third horizontal groove and a fourth horizontal groove spaced apart from each other in a rear surface thereof, the third horizontal groove and the fourth horizontal groove being open toward the opposite sides of the main body member, respectively, a plurality of third horizontal grooves being spaced apart from each other in the longitudinal direction of the main body member, and a plurality of fourth horizontal grooves being spaced apart from each other in the longitudinal direction of the main body member.

2. The blast-triggering device of claim 1, wherein an upper end of the detonator casing member is formed in a hemispherical shape around a central upper flat surface of the detonator casing member.

3. The blast-triggering device of claim 2, wherein an external diameter of the detonator casing member is 7.1~8.5 mm and an internal diameter thereof is 5.5~7.0 mm.

4. The blast-triggering device of claim 2, wherein the lower surface of the connector head is formed to have a flat surface corresponding to the central upper flat surface of the detonator casing member and a round surface corresponding to the hemispherical shape thereof.

5. The blast-triggering device of claim 2, wherein an upper surface of the connector body is provided with side protrusions for supporting tubes, the side protrusions for supporting tubes protruding into the tube insertion portion to be spaced apart from each other, receiving an upper end of the trunkline delay detonator therebetween, and each having a semicircular shape when viewed from a lateral direction of the connector body.

6. The blast-triggering device of claim 1, wherein the base charge member includes one explosive selected from among tricinate, diazodinitrophenol (DDNP), tetracene, and mercury fulminate.

7. The blast-triggering device of claim 1, wherein the base charge member uses one explosive selected from among explosives each having one value of falling hammer sensitivity and friction sensitivity equal to or less than a corresponding value of lead azide (LA) and a remaining value thereof less than a corresponding value of LA, thereby being less sensitive and less powerful than LA.

8. The blast-triggering device of claim 1, wherein the trunkline delay detonator further comprises:

a powder removal plate member, which is positioned at an upper end of the delay line member, has a center hole therein, and is configured such that an outer circumference thereof is in contact with an inner circumferential surface of the detonator casing member to remove base charge powder remaining on the inner circumferential surface thereof.

9. The blast-triggering device of claim 1, wherein the connector body, the connector head, and the clip-fixing body are integrally formed in a single body, and are each made by using one material or mixing at least two materials selected from among high-density polyethylene, intermediate-density polyethylene, polypropylene, metallocene linear low-density polyethylene, and polyamide.

10. The blast-triggering device of claim 1, wherein the fixing clip is provided with a tube-fitting groove in which the detonation tube connected to the trunkline delay detonator is fitted, so that a lower end of the trunkline delay detonator is supported when the detonation tube is inserted into and fitted in the tube-fitting groove.

11. The blast-triggering device of claim 1, wherein a total length including the connector body, the connector head, and the clip-fixing body is 65~110 mm, and a thickness between opposite side surfaces of the connector body is 15~50 mm, a diameter of the detonator insertion portion is 7.1~9.5 mm, a thickness between the upper surface and the lower surface of the connector head is 3~15 mm, and a gap between the lower surface of the connector head and an outer upper circumferential surface of the side protrusion for supporting tubes is 2.5~4.5 mm.

* * * * *